US011440702B2

(12) United States Patent
de Almeida Verdasca Pereira

(10) Patent No.: US 11,440,702 B2
(45) Date of Patent: Sep. 13, 2022

(54) PALLET BLOCK, PALLET INCLUDING SAME AND PROCESS FOR OBTAINING SAME

(71) Applicant: Madeca—Madeiras de Caxarias, S.A., Caxarias (PT)

(72) Inventor: Paulo Manuel de Almeida Verdasca Pereira, Ourem (PT)

(73) Assignee: MADECA—MADEIRAS DE CAXARIAS, S.A., Caxarias (PT)

( * ) Notice: Subject to any disclaimer, the term of this patent is extended or adjusted under 35 U.S.C. 154(b) by 0 days.

(21) Appl. No.: 16/770,343

(22) PCT Filed: Dec. 6, 2017

(86) PCT No.: PCT/PT2017/000020

§ 371 (c)(1),
(2) Date: Jun. 5, 2020

(87) PCT Pub. No.: WO2019/112456

PCT Pub. Date: Jun. 13, 2019

(65) Prior Publication Data

US 2020/0361657 A1 Nov. 19, 2020

(51) Int. Cl.
*B65D 19/40* (2006.01)

(52) U.S. Cl.
CPC .... *B65D 19/40* (2013.01); *B65D 2519/00099* (2013.01); *B65D 2519/00273* (2013.01);
(Continued)

(58) Field of Classification Search
CPC ..... B65D 2519/00089; B65D 2519/00099; B65D 2519/00338
(Continued)

(56) References Cited

U.S. PATENT DOCUMENTS 2,432,295 A * 12/1947 Donahue ..... B65D 19/0097 108/52.1
2,503,240 A * 4/1950 Cahners ..... B65D 19/0028 108/51.3
(Continued)

FOREIGN PATENT DOCUMENTS

CA 2350688 A1 * 12/2002 ..... B32B 3/12
CA 2805211 A1 * 1/2012 ..... B31D 5/04
(Continued)

OTHER PUBLICATIONS

International Search Report in PCT International Application No. PCT/PT2017/000020 dated Jul. 25, 2018.

*Primary Examiner* — Jose V Chen
(74) *Attorney, Agent, or Firm* — Mark M. Friedman

(57) ABSTRACT

This invention falls within the scope of pallets, more specifically pallet blocks, which form the base of a pallet or which are arranged between two platforms of a pallet, allowing the entry of forks from forklifts and other mechanisms of handling and stowing in warehouse, means of transport and containers.

It is thus the object of this invention a pallet block (3) comprising a core (1) of wood particleboard and an outer layer (2) of wood fibreboard, the outer layer (2) at least partially coating the core (1), and the assembly formed by the core (1) plus the outer layer (2) being obtained by subjecting it to pressure. This enables a pallet block (3) to be obtained allowing high weights to be supported, without the whole block (3) being comprised of wood fibreboard, and with characteristics of robustness, thus avoiding the need for gluing between the elements.

16 Claims, 2 Drawing Sheets

(52) U.S. Cl.
CPC ..... *B65D 2519/00278* (2013.01); *B65D 2519/00338* (2013.01); *B65D 2519/00343* (2013.01); *B65D 2519/00572* (2013.01)

(58) Field of Classification Search
USPC ..... 108/51.3
See application file for complete search history.

(56) References Cited

U.S. PATENT DOCUMENTS 3,115,105 A * 12/1963 Allen ..... B65D 19/0012 108/51.3
3,434,434 A * 3/1969 Horton, Jr. ..... B65D 19/0028 108/51.3
3,552,328 A * 1/1971 Sullivan ..... B65D 19/0026 108/51.3
3,556,886 A * 1/1971 Reusser ..... B65D 19/0012 156/265
3,626,860 A * 12/1971 Blatt ..... B65D 19/0026 108/51.3
3,695,506 A * 10/1972 Cook ..... B65D 5/10 206/599
3,921,279 A * 11/1975 Daley ..... B23P 13/00 29/458
4,198,912 A * 4/1980 Gramckow ..... B65D 19/0026 108/57.34
4,230,049 A * 10/1980 Horne ..... B29C 70/22 108/51.3
4,244,766 A * 1/1981 Yellen ..... B31D 3/00 156/211
4,966,084 A * 10/1990 Motomaru ..... B65D 19/0012 108/51.3
5,121,696 A * 6/1992 Harder ..... B65D 19/0026 108/51.3
5,129,329 A * 7/1992 Clasen ..... B65D 19/0012 108/51.3
5,230,291 A * 7/1993 Juvik-Woods ..... B65D 19/0012 108/51.3
5,495,810 A * 3/1996 Yoshii ..... B31C 3/00 108/51.3
5,517,926 A * 5/1996 Young, Jr. ..... B65D 19/0026 108/51.3
5,551,353 A * 9/1996 Fiedler ..... B29D 99/001 108/51.3
5,601,035 A * 2/1997 Herring ..... B65D 19/0026 108/51.3
5,605,102 A * 2/1997 Simpson ..... A47F 10/04 108/51.3
5,690,037 A * 11/1997 Hill ..... B65D 19/0026 108/51.11
5,927,211 A * 7/1999 Giasi ..... B65D 19/0028 108/51.3
6,095,061 A * 8/2000 Perazzo ..... B65D 19/0012 108/51.3
2002/0189507 A1* 12/2002 Benner ..... B65D 19/0012 108/51.3
2005/0056193 A1* 3/2005 Laender ..... B65D 19/0081 108/56.3
2005/0145143 A1* 7/2005 Moore ..... B65D 19/0012 108/51.3
2010/0107933 A1* 5/2010 Love ..... B65D 19/0069 108/51.3
2015/0191274 A1* 7/2015 Linares ..... B26D 1/385 493/405

FOREIGN PATENT DOCUMENTS

CH 362 031 A 5/1962
DE 19636554 A1 * 3/1998 ..... B65D 19/0026
DE 10 2013 215284 A1 2/2015
EP 1 942 061 A1 6/2008

* cited by examiner

PALLET BLOCK, PALLET INCLUDING SAME AND PROCESS FOR OBTAINING SAME

RELATED APPLICATIONS

This application is a U.S. 371 national phase patent application of PCT International Patent Application No. PCT/PT2017/000020, filed on Dec. 6, 2017, the disclosure of which is incorporated herein by reference in its entirety.

FIELD OF THE INVENTION

This invention falls within the scope of pallets, more specifically pallet blocks, which form the base of a pallet or which are arranged between two platforms of a pallet, allowing the entry of forks from forklifts and other mechanisms of handling and stowing in warehouse, means of transport and containers.

BACKGROUND OF THE INVENTION

The prior art which is the closest to this invention relates to pallets with blocks made from a single material, typically consisting of a single wood fibre agglomerate or the bonding of wood fibreboard and particleboard agglomerates by gluing, thus being comprised by structural elements of pallets with higher expenditure of wood fibres raw material and lower capacity to fix the structural elements (only wood fibre agglomerate) or with reduced durability and robustness, as they require the bonding between the different types of wood agglomerate.

SUMMARY OF THE INVENTION

It is thus the object of the present invention a pallet block (3) comprising a core (1) of wood particleboard and an outer layer (2) of wood fibreboard, the outer layer (2) at least partially coating the core (1), and the assembly formed by the core (1) plus the outer layer (2) being obtained by subjecting it to pressure. This allows a pallet block (3) to be obtained—which fulfils the basic functions of a pallet or which is arranged between two pallets of a platform—allowing high weights to be supported without the whole block (3) being comprised of wood fibres agglomerate, but only its external part. The outer layer (2) allows for greater robustness, avoiding the breakdown resulting from the use during the useful life of the block. On the other hand, the wood particleboard core (1) additionally fulfils a function of resistance and retention of the metal binding elements. Obtainment by subjecting to pressure avoids the need for gluing, which reduces the durability and robustness of the pallet blocks (3) of the state of the art.

According to an improved configuration of the block (3) of this invention, the outer layer (2) has a tubular configuration and the core (1) is formed inside the outer layer (2). Such a configuration enables manufacture by mould pressing—thus enabling a highly simplified industrial process—while maintaining the aforementioned advantages. Preferably, the core (1) has a prismatic or cylindrical configuration, and the outer layer (2) consists of a prismatic or circular tube which coats the side faces of the core (1).

According to an improved embodiment of the block (3) of this invention, the edges between two external faces of the outer layer (2) are cut off. This enables a block (3) of greater consistency to be provided, when it has a prismatic or cylindrical tubular configuration.

Further, according to another improved embodiment of the block (3) of this invention, the wood particleboard of the core (1) and the wood fibreboard of the outer layer (2) are glued together. This allows for a final product to be obtained which has high strength and high load bearing capacity, and which is compatible with the manufacture of a product by mould pressing. Preferably, said gluing of the wood particleboard of the core (1) and the wood fibreboard of the outer layer (2) is made by using thermosetting glue, more preferably thermosetting resin. Thus, the block (3) is obtainable by a highly simplified process in which the particle agglomerates are susceptible of achieving a high resistance by using heat-hardenable glue.

Yet according to another improved embodiment of the block (3) of this invention, an external surface of the outer layer (2) is pigmented. This enables an easy identification of a block, without the need to pigment the entire block, but only the outer layer (2).

Specifically, it is also the object of this invention to provide a pallet comprising at least one platform and at least four pallet blocks (3), according to any of the configurations disclosed in this patent application, which are attached to the periphery of one same face of the said platform.

In a preferred embodiment, the said pallet comprises two platforms between which the said blocks are arranged, the latter (3) being attached in the periphery of one same face of each one of the platforms.

It is also the object of this invention to provide a process for obtaining a pallet block (3), which comprises the following steps:

- bonding of wood particleboard and wood fibreboard with glue;
- inserting the wood particleboard into an inner area of a prismatic or cylindrical mould and the wood fibreboard into an entire side layer surrounding said inner area of the said mould;
- closing the said mould and subjecting the interior thereof to a pressure in the range of 35-45 kgf/cm$^2$, preferably 40 kgf/cm$^2$, so that the bonding glue is cured, preferably at a temperature between 180 and 220° C.

This process allows a pallet block (3) to be obtained which supports high weights without the whole block (3) being comprised of wood fibres agglomerate, but only its external part. On the other hand, it provides a pallet block (3) in which the wood particleboard core (1) additionally fulfils a function of resistance and retention of the metal binding elements.

DETAILED DESCRIPTION OF THE INVENTION

Figure 1:
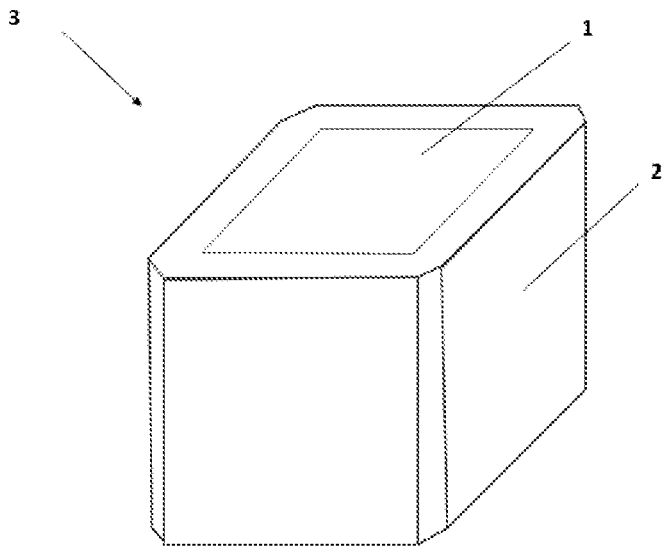
FIG. 1—illustration of a first embodiment of a pallet block (3) according to this invention, having a general cubic configuration, in which the outer layer (2) has a quadrangular tube configuration, and the core (1) has a quadrangular prism configuration. The edges of the block, formed in the outer layer (2), are cut. The block (3) is obtained by pressing, thus forming an optimal connection between the core (1) and the outer layer (2).
Figure 2:
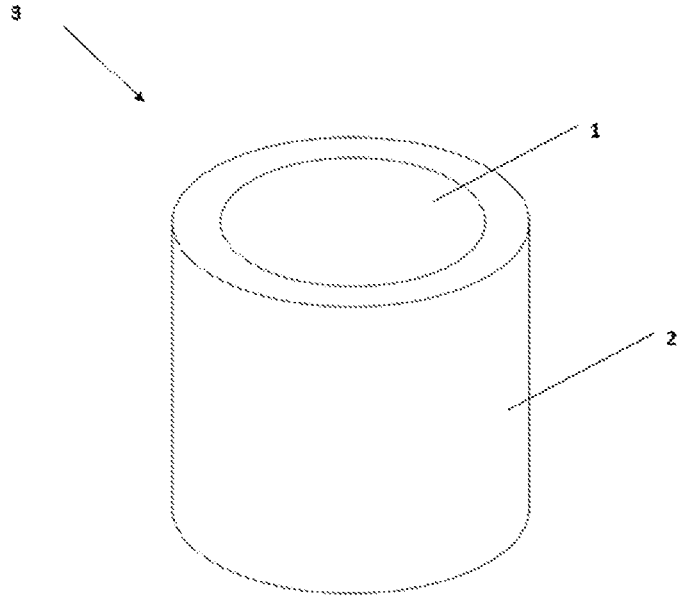
FIG. 2—illustration of a second embodiment of a pallet block (3) according to this invention, having a general cylindrical configuration, in which the outer layer (2) has a cylindrical tube configuration, and the core (1) has a quadrangular prism configuration.
Figure 3:
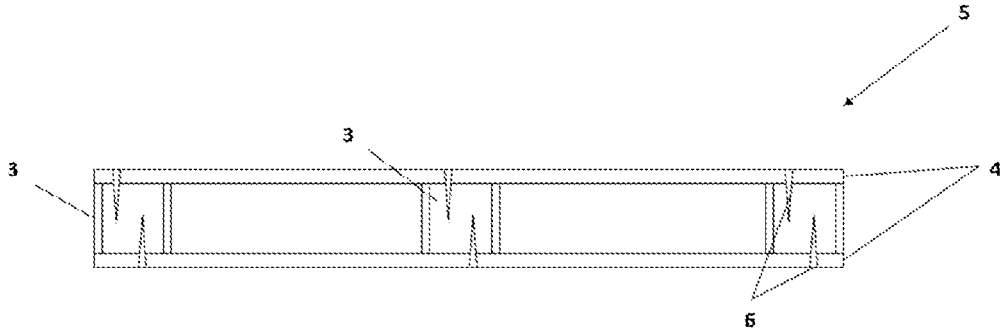
FIG. 3—illustration of a side view of an embodiment of a pallet (5) according to this invention, showing two platforms (4)—provided above and below the blocks (3)—and three blocks (3) according to the embodiment of FIG. 1. The pallet comprises further sets of two platforms (4) and three blocks (3) (not shown), which form the pallet (5). In addition, the pallet comprises studs (6) which are arranged so that each one of the blocks (3) is attached to the platform.

The general advantageous configurations of the present invention are described in the Summary of the invention. Such configurations are detailed below in accordance with other advantageous and/or preferred embodiments of this invention.

In a preferred embodiment of the block (3) which is the object of this invention, the gluing of the wood particleboard of the core (1) and the wood fibreboard of the outer layer (2) is carried out by curing the glue under pressure. Therefore, since the block (3) of this invention is comprised of a core (1) of wood particleboard and an outer layer (2) of wood fibreboard, and provided that these are glued to each other, the whole assembly can be formed by pressure, namely in mould, thus enabling its obtainment through a highly simplified industrial process.

In yet another preferred embodiment of the pallet block (3) according to this invention, the outer layer (2) has a rectangular tube configuration and the core (1) consists of a parallelepiped or the outer layer (2) has a circular tube configuration and the core (1) consists of a cylinder.

In yet another preferred embodiment of the pallet block (3) according to this invention, the latter is obtained by the following steps:

- bonding of wood particleboard and wood fibreboard with glue;
- inserting the wood particleboard into an inner area of a prismatic or
- cylindrical mould and the wood fibreboard into an entire side layer surrounding said inner area of the said mould;
- closing the said mould and subjecting the interior thereof to a pressure in the range of 35-45 kgf/cm$^2$, preferably 40 kgf/cm$^2$, so that the bonding glue is cured, preferably at a temperature between 180 and 220° C.

Such a block (3) is obtainable by a highly simplified industrial process, still resulting in a block (3) which supports high weights and is resistant to aggression from external agents.

Preferably, the thickness of this outer layer (2) is from 10 to 15 mm. Preferably, the outer layer is made from medium density fibreboard (MDF).

Preferably, the said prismatic or cylindrical mould has cut edges between each two side faces, so as to ensure greater consistency of the block.

In addition, the block (3) of this invention is obtainable by a process in which, after said submission to pressure, demoulding is carried out with subsequent cooling.

In another configuration of the process for obtaining a pallet block (3) according to the present invention, after said demoulding and cooling, burrs and/or debris of excess material from the walls of said mould are cleaned.

Additionally, the step of bonding the wood fibreboard according to the process for obtaining a pallet block (3) may comprise the addition of a pigment.

It is also an object of the present invention to provide a process for obtaining a pallet comprising the step of attaching at least one platform to at least four blocks (3) obtained according to the process for obtaining the pallet block (3) of the present invention. Preferably, the process for obtaining the pallet of the present invention further includes the step of attaching, in the periphery of one same face, each of the two platforms to the said blocks, which are thus arranged between the two platforms.

EMBODIMENTS

In an embodiment of the object of this invention, the said core (1) has a cubic configuration and the said outer layer (2) has a quadrangular tube configuration.

In an embodiment of the pallet of this invention, it comprises studs which are arranged so that each one of the said blocks (3) is attached to the platform, each of the studs perforating the whole outer layer (2) and part of the core (1) of each block.

In another embodiment of the pallet according to this invention, it comprises nine blocks.

Particular aspects of an embodiment of the pallet block (3) according to this invention are hereinafter disclosed.

The dimensions of a pallet block (3) according to the present invention vary depending on the type of pallet, preferably having pallet block (3) standard dimensions according to the EU marking.

The block (3) which is the object of this patent application has a wood particleboard core (1) and an outer layer (2), arranged across the horizontal contour, in fibreboard, thereby forming a tubular configuration.

The outer layer (2) of the fibreboard consists of pigmented material in order to customize this type of new product. The colour thus appears throughout the volume of fibreboard and not just on its surface. The block (3) has the vertical side edges cut in order to give an increased consistency to the product.

Particular aspects of an embodiment relating to the process for obtaining the pallet block (3) according to this invention are hereinafter disclosed.

The manufacturing process comprises the bonding of the wood particles (uniform spreading of the thermosetting glue) and, separately, the bonding of the wood fibres with addition of the pigment. The relative percentages of glue are different for the two materials, not only because they have a very different and specific surface, but also due to the fact that the fibreboard requires a greater relative amount of glue so as to provide a harder and impact-resistant surface.

After both materials have been prepared, the appropriate dosage is made in order to obtain the desired thickness of the enveloping layer (particleboard mass and fibreboard mass). The two materials are inserted into a mould, with the particleboard in the inner region and the fibreboard throughout the lateral enveloping layer.

After the mould or the injection system has been filled, high temperature pressure is applied to allow the glue to be cured within a short time (a few minutes).

After demoulding or exiting the extruder, the material is allowed to cool for complete curing of the glue and loss of the residual moisture.

After cooling, the manufacture of the block (3) is finished, requiring only minor cleaning of burrs or debris of material in excess from the walls of the mould.

The use of these blocks (3) is the construction of load platforms (pallets), with characteristics that allow the entry of forks from forklift trucks and other mechanisms of handling and stowing in warehouse, means of transport and containers.

The blocks (3) constitute the four corners, four lateral heights and an inner height. A common pallet uses a total of 9 blocks.

This two-material block (3) allows the performance of its structural function, essentially by means of the glued particleboard inner core (1). This core (1) receives the fixing elements (studs). The protective outer layer (2) in a glued wood fibreboard has a function of protection against breakdown resulting from the use during the useful life of the block, in addition to providing greater hygiene, aesthetic value and product customization.

As will be evident to a person skilled in the art, the present invention shall not be limited to the embodiments described herein, and a number of changes are possible which remain within the scope of the invention.

The preferred embodiments above described are obviously susceptible of being combined, in the different possible forms, thus being herein avoided the replication of all such combinations.

The invention claimed is:

1. A pallet block (3) comprising a core (1) of wood particleboard and an outer layer (2) of wood fibreboard, the outer layer (2) at least partially coating the core (1), and wherein the core (1) and the outer layer (2) are subjected to pressure to form an unitary structure assembly formed as one, in which the outer layer (2) has a tubular configuration and the core (1) is formed inside the outer layer (2), such that the pallet block is dimensioned for placement at individual and spaced-apart locations along a length of a pallet.

2. A block (3) according to claim 1, wherein the outer layer (2) has a rectangular tube configuration and wherein the core (1) consists of a parallelepiped or the outer layer (2) has a circular tube configuration and the core (1) consists of a cylinder.

3. A block (3) according to claim 1, wherein edges between two external faces of the outer layer (2) are cut.

4. A block (3) according to claim 1, wherein the wood particleboard of the core (1) and the wood fibreboard of the outer layer (2) are bonded with glue.

5. A block (3) according to claim 4, wherein the gluing of the wood particleboard of the core (1) with the wood fibreboard of the outer layer (2) is made by using thermosetting glue.

6. A block (3) according to claim 4, wherein the gluing of the wood particleboard of the core (1) and the wood fibreboard of the outer layer (2) is carried out by curing the glue under pressure.

7. A block (3) according to claim 1, wherein an external surface of the outer layer (2) is pigmented.

8. A process for obtaining a pallet block (3) according to claim 1 comprising the following steps: bonding of wood particleboard and wood fibreboard with glue; inserting the wood particleboard into an inner area of a prismatic or cylindrical mould and the wood fibreboard into an entire side layer surrounding the inner area of the mould; and closing the mould and subjecting the interior thereof to a pressure in the range of 35-45 $kgf/cm^2$ so that the bonding glue is cured.

9. A process according to claim 8, wherein after the subjection to pressure, demoulding is carried out with subsequent cooling of the block (3) obtained from the cure.

10. A process according to claim 9, wherein, after the demoulding and cooling, burrs and/or debris of excess material from the walls to the mould are cleaned.

11. A process according to claim 8, wherein the step of bonding the wood fibreboard comprises the addition of a pigment.

12. A process for obtaining a pallet comprising the step of attaching at least one platform to at least four blocks (3) obtained according to the process provided for in claim 8.

13. A process according to claim 12, wherein the step of attaching includes attaching in the periphery of one same face each of the two platforms to the blocks, which are thus arranged between the two platforms.

14. A pallet comprising at least one platform and at least four blocks (3), each block (3) comprising a core (1) of wood particleboard and an outer layer (2) of wood fibreboard, the outer layer (2) at least partially coating the core (1), wherein the core (1) and the outer layer (2) are subjected to pressure to form an unitary structure assembly formed as one, in which the outer layer (2) has a tubular configuration and the core (1) is formed inside the outer layer (2), such that the pallet block is dimensioned for placement at individual and spaced-apart locations along a length of a pallet, the blocks (3) being attached in a periphery of one same face of the platform.

15. A pallet according to claim 14, further comprising studs, which are arranged so that each one of the blocks (3) is attached to the platform, each of the studs perforating the whole outer layer (2) and part of the core (1) of each block.

16. A pallet according to claim 14, further comprising two platforms between which the blocks are arranged, the blocks (3) being attached in the periphery of one same face of each of the platforms.

* * * * *